US006455992B1

(12) United States Patent
Thomson et al.

(10) Patent No.: US 6,455,992 B1
(45) Date of Patent: Sep. 24, 2002

(54) COLOR PICTURE TUBE HAVING A LOW EXPANSION TENSION MASK ATTACHED TO A HIGHER EXPANSION FRAME

(75) Inventors: Mark Allen Thomson; Edward Richard Garrity, Jr.; James Francis Edwards, all of Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/290,322

(22) Filed: Apr. 12, 1999

(51) Int. Cl.[7] ..... H01J 29/80; H01J 29/81; H01J 29/82

(52) U.S. Cl. ..... 313/407; 313/402; 313/404; 313/405

(58) Field of Search ..... 313/402, 407, 313/403, 404; 445/30; 228/175

(56) References Cited

U.S. PATENT DOCUMENTS

| | | | | |
|---|---|---|---|---|
| 2,842,696 A | | 7/1958 | Fischer-Colbrie | 313/78 |
| 3,808,493 A | * | 4/1974 | Kawamura et al. | 313/85 |
| 4,739,216 A | * | 4/1988 | Yamazaki et al. | 313/407 |
| 4,994,712 A | * | 2/1991 | Strauss | 313/405 |
| 5,023,507 A | | 6/1991 | Dougherty et al. | 313/407 |
| 5,085,606 A | * | 2/1992 | Kaplan et al. | 445/30 |
| 5,554,909 A | * | 9/1996 | Brennesholtz | 313/402 |
| 5,594,300 A | * | 1/1997 | Nosker et al. | 313/402 |
| 5,952,774 A | * | 9/1999 | Diven et al. | 313/402 |
| 6,084,342 A | * | 7/2000 | Ragland, Jr. | 313/407 |

FOREIGN PATENT DOCUMENTS

| | | | |
|---|---|---|---|
| GB | 2308223 A | 6/1997 | H01J/9/14 |
| GB | 2311165 A | 9/1997 | H01J/9/14 |

OTHER PUBLICATIONS

PCT Search Report dated Jun. 28, 2000.

* cited by examiner

*Primary Examiner*—Ashok Patel
*Assistant Examiner*—Sikha Roy
(74) *Attorney, Agent, or Firm*—Joseph S. Tripoli; Dennis H. Irlbeck; Carlos M. Herrera

(57) ABSTRACT

The present invention provides an improvement in a color picture tube having a tension mask supported by a support frame mounted within said tube. The mask has a significantly lower coefficient of thermal expansion than the frame. The frame has two substantially parallel cantilevered members, each member has a distal edge to which the tension mask is attached. At least one of the distal edges has two sections separated by a gap therebetween. The two sections include an inner section and an outer section. The mask is glued to the inner section and is welded to the outer section.

2 Claims, 3 Drawing Sheets

COLOR PICTURE TUBE HAVING A LOW EXPANSION TENSION MASK ATTACHED TO A HIGHER EXPANSION FRAME

This invention relates to color picture tubes having tension masks, and particularly to a tube having means for connecting a tension mask, that is made of a material having a relatively low coefficient of thermal expansion material, to a support frame, that has a significantly higher coefficient of thermal expansion.

BACKGROUND OF THE INVENTION

A color picture tube includes an electron gun for generating and directing three electron beams to the screen of the tube. The screen is located. on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion, such as Invar. However, a mask from such material would require a support frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is relatively costly to make both the mask and frame out of identical or similar low expansion materials. Therefore, it is desirable to use the combination of a low expansion tension mask with a higher expansion support frame. However, a thermal expansion mismatch between mask and frame often results in mask wrinkles following thermal processing, which may involve temperatures as high as 450° C., such as during frit sealing. One solution to deal with this expansion mismatch is to individually weld each mask strand to the frame. It has been found that such individual welding of the strands of a tension mask to a frame causes the mask strands to become misaligned, when existing roller welders are used.

The present invention addresses a need for a solution to the problem, of attaching a tension mask to a frame, that exists when there is a substantial mismatch in coefficients of thermal expansion between a tension mask and its support frame.

SUMMARY OF THE INVENTION

The present invention provides an improvement in a color picture tube having a tension mask supported by a support frame mounted within the tube. The mask has a significantly lower coefficient of thermal expansion than the frame. The frame has two substantially parallel cantilevered members, each member having a distal edge to which the tension mask is attached. At least one of the distal edges has two sections separated by a gap therebetween. The two sections include an inner section and an outer section. The mask is glued to the inner section and is welded to the outer section.

DETAILED DESCRIPTION OF THE PREFERRED EMBODIMENTS

Figure 1:
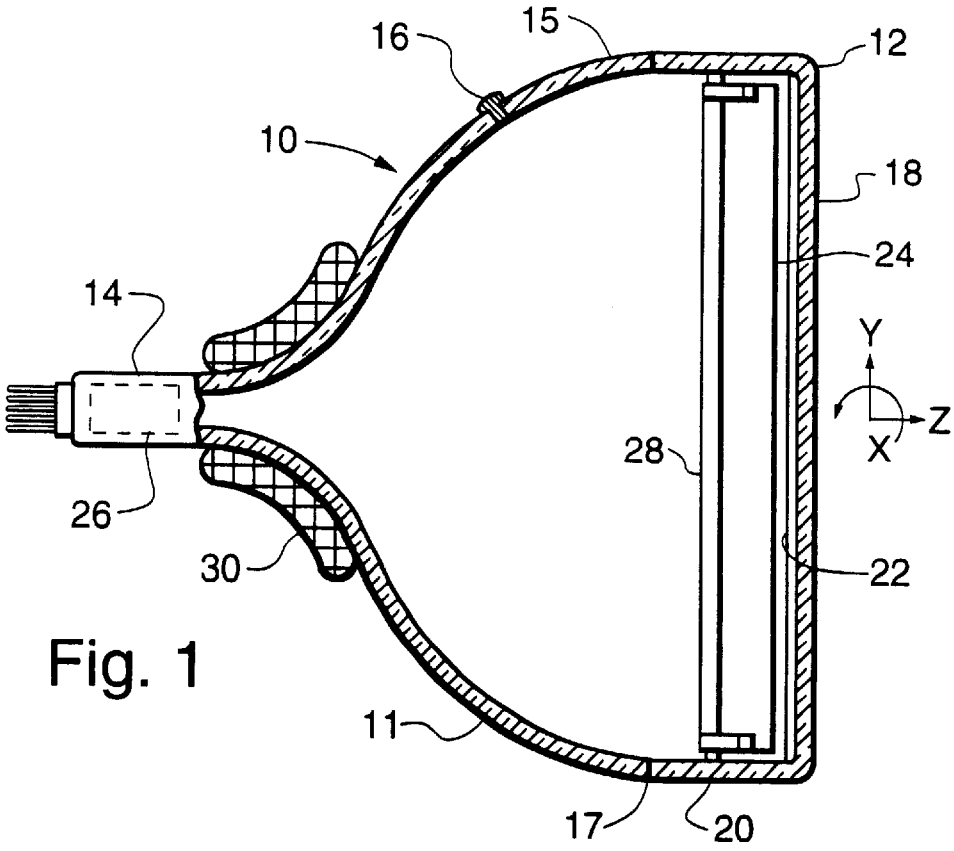
FIG. 1 is a side view, partly in axial section, of a color picture tube embodying the invention.

FIG. 1 shows a color picture tube 10 having a glass envelope 11 comprising a rectangular faceplate panel 12 and a tubular neck 14 connected by a funnel 15. The funnel 15 has an internal conductive coating (not shown) that extends from an anode button 16 toward the panel 12 and to the neck 14. The panel 12 comprises a substantially cylindrical viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of three colors. A color selection tension mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22. The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
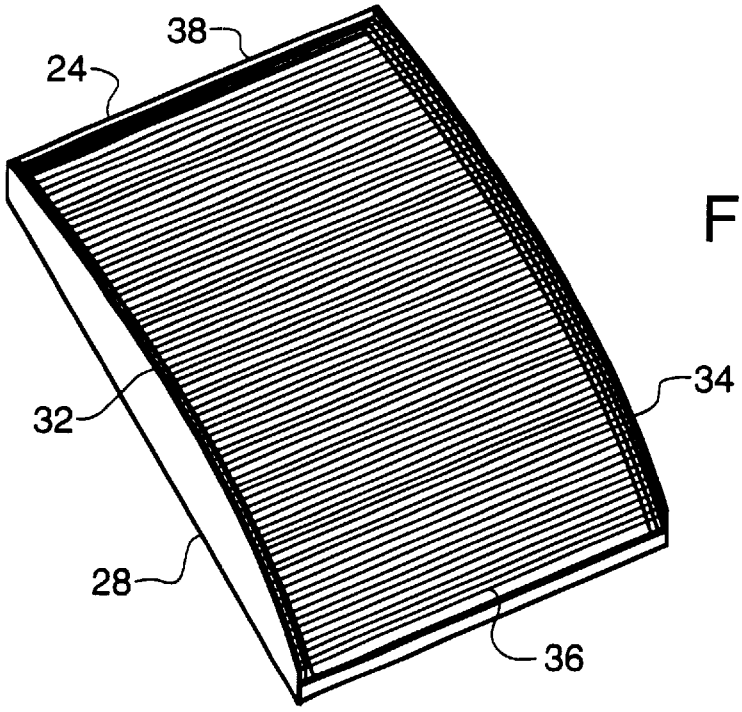
FIG. 2 is a perspective view of a tension mask-frame assembly.
Figure 3:
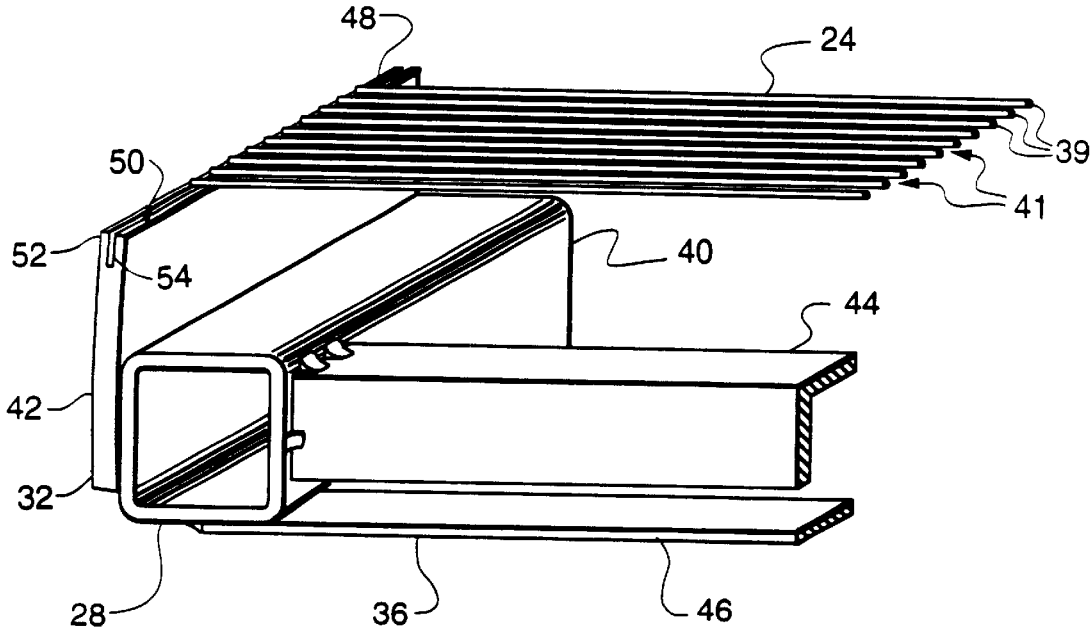
FIG. 3 is a partial perspective view of the mask-frame assembly of FIG. 2.

The tension mask 24, as shown in FIGS. 2 and 3, is attached to a peripheral frame 28 that includes two long sides 32 and 34, and two short sides 36 and 38. The two long sides 32 and 34 of the frame parallel a central major axis, X, of the tube; and the two short sides 36 and 38 parallel a central minor axis, Y, of the tube. The tension mask 24 includes an apertured portion that contains a plurality of metal strands 39 having a multiplicity of elongated slits 41 therebetween that parallel the minor axis of the mask. Each slit 41 extends between the two long sides 32 and 34 of the mask 24.

As shown in greater detail in FIG. 3, each of the two long sides 32 of the frame 28 includes a rigid section 40 and a compliant member 42 cantilevered from the rigid section. The rigid sections 40 are hollow tubes, and the compliant members 42 are metal plates. The compliant members 42 substantially parallel each other and may vary in height from the center of each section longitudinally to the ends of the sections, to permit the best tension compliance over the mask. Each of the short sides 36 and 38 (not shown) has an L-shaped cross-section upper portion 44 parallel to and separated from a flat bar-shaped lower portion 46.

Each compliant member 42 has a distal edge 48 to which the strands 39 of the tension mask 24 are attached. The distal edge 48 of at least one of the compliant members 42 has two sections 50 and 52 separated by a gap 54 therebetween. The two sections 50 and 52 include an inner section 50 and an outer section 52. The mask 24 is glued to the inner section 50 and is welded to the outer section 52.

Figure 4:
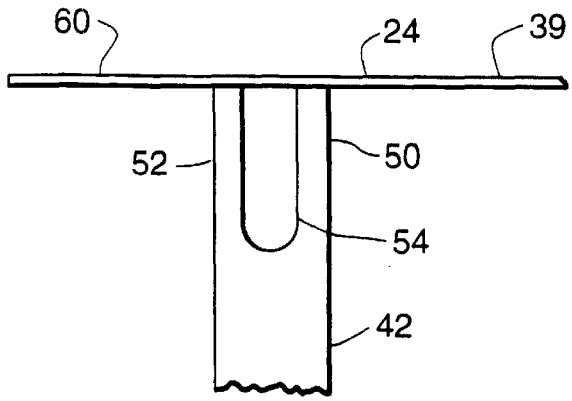
FIGS. 4 through 7 are side views of a cantilevered flange of the frame of FIG. 3.
Figure 5:
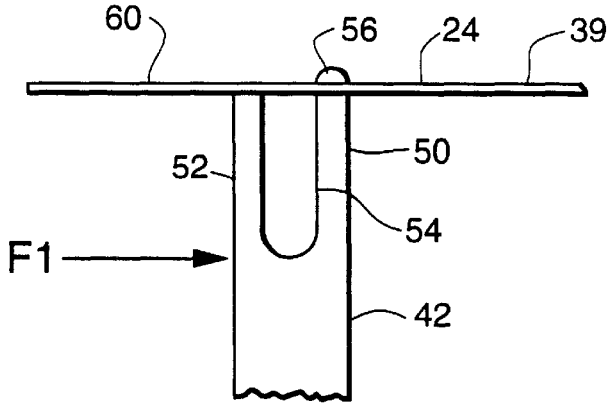
Figure 6:
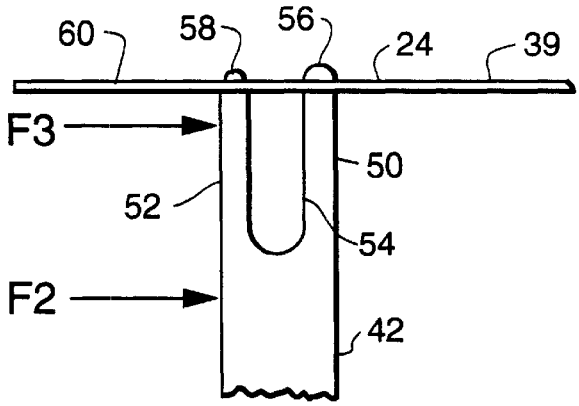
Figure 7:
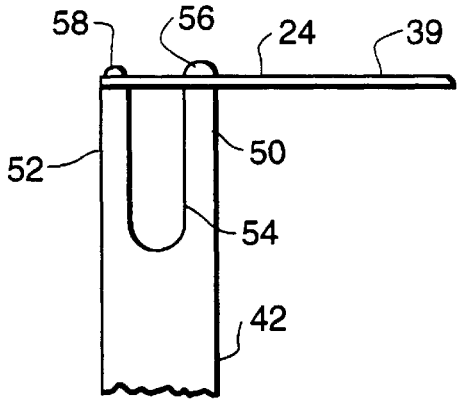

FIGS. 4 through 7 illustrate the steps taken to attach the mask 24 to compliant members 42 of the frame 28. First, the mask 24 is stretched between the two compliant members 42, as shown in FIG. 4. Next, forces F1 are applied to the compliant members 42 to move them slightly together, and glue 56 is applied to seal the mask strands 39 to the inner sections 50 of the compliant members 42, as shown in FIG. 5. After the glue 56 has dried, the forces F1 are changed to reduced forces F2, other forces F3 are applied to the outsides of the outer sections 52, and the mask strands 39 are attached to the outer sections 52 by welds 58, as shown in FIG. 6. The sum of the forces F2 and F3 should be such that the joint produced by glue 56 is not substantially moved, while a light tension in the mask is maintained. The generated spring force between the inner and outer sections 50 and 52 should be similar to the desired final mask tension. Once the mask is welded, a border 60 of the mask 24 is trimmed, and the forces F2 and F3 are released from the frame, as shown in FIG. 7. Utilization of this two-attachment process ensures that the positions of the strands are maintained by the glue when the welds are made.

To achieve the proper tension forces in the mask 24 along the entire length of the compliant members 42 requires either that the forces F3 on the outer sections 52 of the cantilevered compliant members 42 be varied along the mask, or that the spring constant of the outer sections 52 be varied along the compliant members 42. This latter technique of varying the spring constant can be achieved in many different ways. For example, the thickness of the outer section 52 can be varied either by machining, by moving the position of the gap 54, or by varying the depth of the gap 54.

Utilization of a tube design that allows for two step attachment of a tension mask, permits attachment of individual strands of a tension mask, while preventing misalignment of the strands relative to a mask frame. This advantage is achieved because the first step of gluing the strands 39 to the inner sections 50 holds the strands in place until they can be welded to the outer sections 52.

In one preferred embodiment, the rigid sections 40 of the long side members 32 and 34 are hollow square tubes of 4130 steel having a wall thickness of 0.175 cm. The thickness of the compliant members is determined by considering mask thickness, the flexibility of the total mask-frame assembly and the desired warp misregistration limits. In a further preferred embodiment, the compliant members 42 are plates of 4130 stainless steel that are 0.157 cm thick. The two L-shaped upper portions 44 are preferably of CRS-1018 steel having a thickness of 0.318 cm. The two bar-shaped lower portions 46 are preferably of 300 Series stainless steel having a thickness of about 3 cm, which has a different coefficient of thermal expansion than does the CRS-1018 steel of the upper portions 44. When the frame 28 is heated, the lower portions 46 expand more than do the upper portions 44.

Although the rigid sections 40 have been shown as hollow square tubes, other preferred configurations, such as those having L-shaped, C-shaped or triangular-shaped cross-sections, are also possible for these sections. Furthermore, although the short sides 36 and 38 of the frame 28 have been shown as having L-shaped cross-sections, other preferred configurations may be used, such as C-shaped, triangular shaped or box-shaped.

What is claimed is:

1. A color picture tube comprising a tension mask supported by a support frame mounted within said tube, said mask having a significantly lower coefficient of thermal expansion than said frame, said frame having two substantially parallel cantilevered members, each member having a distal edge to which said tension mask is attached, at least one of said distal edges having two sections separated by a gap therebetween, said two sections including an inner section and an outer section, wherein the depth of said gap varies along the length of said distal edges.

2. A color picture tube comprising a tension mask supported by a support frame mounted within said tube, said mask having a significantly lower coefficient of thermal expansion than said frame, said frame having two substantially parallel cantilevered members, each member having a distal edge to which said tension mask is attached, at least one of said distal edges having two sections separated by a gap therebetween, said two sections including an inner section and an outer section, and said mask being attached to said sections wherein the thickness of said outer section varies along the length of said distal edge.

* * * * *